US009204700B1

(12) United States Patent
Hsu

(10) Patent No.: US 9,204,700 B1
(45) Date of Patent: Dec. 8, 2015

(54) HAIR STYLING DEVICE AND CREATION METHOD THEREOF

(71) Applicant: Shih-Ling Hsu, Tainan (TW)

(72) Inventor: Shih-Ling Hsu, Tainan (TW)

( * ) Notice: Subject to any disclaimer, the term of this patent is extended or adjusted under 35 U.S.C. 154(b) by 0 days.

(21) Appl. No.: 14/447,664

(22) Filed: Jul. 31, 2014

(51) Int. Cl.
*A45D 8/00* (2006.01)
*A45D 8/34* (2006.01)
*A45D 8/36* (2006.01)

(52) U.S. Cl.
CPC .. *A45D 8/34* (2013.01); *A45D 8/36* (2013.01); *Y10T 24/39* (2015.01); *Y10T 24/3996* (2015.01)

(58) Field of Classification Search
CPC ..... A45D 8/00; A45D 8/34; A45D 2008/345; A45D 8/36; A45D 2008/002; Y10T 24/39; Y10T 24/3996
See application file for complete search history.

(56) References Cited

U.S. PATENT DOCUMENTS 1,627,469 A * 5/1927 Syptroth ..... 132/54
2,573,806 A * 11/1951 Paterson ..... 403/216
2,845,670 A * 8/1958 Brown et al. ..... 24/16 R
3,165,091 A * 1/1965 Welton ..... 119/805
3,466,712 A * 9/1969 Behney ..... 403/283
4,895,402 A * 1/1990 Tomita ..... 292/307 R
7,574,779 B2 * 8/2009 Takahashi ..... 24/136 L
7,784,432 B1 * 8/2010 Johnson ..... 119/805
2011/0107557 A1 * 5/2011 Bourke et al. ..... 24/115 R

FOREIGN PATENT DOCUMENTS

EP 704178 A1 * 4/1996
GB 2416487 A * 2/2006

* cited by examiner

*Primary Examiner* — Robyn Doan
(74) *Attorney, Agent, or Firm* — Alan D. Kamrath; Kamrath IP Lawfirm, P.A.

(57) ABSTRACT

A hair styling device includes an integrated elastic loop, at least one spacer, and at least one fastener. The elastic loop includes a pair of elastic cord portions. The spacer has two spaced through-holes internally, and a middle passage is formed between and communicates the through-holes. The elastic cord portions of the elastic loop, which penetrates the spacer, are held in the through-holes of the spacer, and the elastic loop is spaced into a first loop and a second loop. The middle fastener penetrates the middle passage of the spacer to separate the elastic cord portions in the spacer and resists the elastic cord portions to allow the elastic cord portions to be securely held in the spacer. The hair styling device also provides a creation method of the hair styling device.

4 Claims, 13 Drawing Sheets

HAIR STYLING DEVICE AND CREATION METHOD THEREOF

BACKGROUND OF THE INVENTION

The present invention relates to a hair styling device and, more particularly, to a hair styling device for both styling the hair and retaining the hair style in place and to a method for creating the hair styling device.

As a tool for hair styling, a hair styling accessory or device can be manipulated by a user for designs of multiple hair styles. A conventional hair styling accessory includes an elastic cord and a plurality of perforated spacers. The elastic cord with two ends tied together develops a loop body which can be stretched for development of a pair of elastic strands. The perforated spacers are mounted on the two elastic strands, so that the loop body is spaced into a plurality of loop sections through which a user's hairs to be braided penetrate. In one embodiment, the perforated spacers are beads with apertures therein, and the aperture in each spacer can be penetrated by the two elastic strands which have been stretched to shrink outer diameters thereof, so that the perforated spacers are coupled with the two elastic strands which are not stretched. In another embodiment, the conventional perforated spacer consists of two semi-cylindrical portions which adhere to each other in order to securely hold and externally position the pair of elastic strands.

The conventional hair styling accessory which works partially does not allow more perforated spacers to be added into or does not allow redundant perforated spacers to be removed from the elastic cord practically when the elastic cord assembly has been completed with the two ends of the elastic cord tied. In addition, the other problem is observed in the perforated spacers, which are not coupled with the pair of elastic strands tightly and usually loosen after a period of time. Namely, the perforated spacers cannot be securely mounted on the elastic cord which is not stretched.

BRIEF SUMMARY OF THE INVENTION

It is an objective of the present invention to provide a hair styling device and a creation method thereof. The hair styling device, which is used in fixing hairs and taken as a tool of braiding hairs, includes spacers changeable conveniently and effectively without the problem of the spacers becoming easily loosened.

To achieve this and other objectives, a hair styling device of the present invention includes an endless elastic loop, at least one spacer, and at least one middle fastener. The endless elastic loop is an integrated one-piece component made of elastic material and includes a pair of elastic cord portions extending in a longitudinal direction. The spacer is an integrated hollow sleeve and includes first and second side portions opposite to each other. The spacer further includes first and second joint portions which are connected between both ends of the first and second side portions respectively. A through-hole is defined in each of the first and second side portions and extends in the longitudinal direction. The through-holes defined in the first and second side portions are spaced by a middle passage. The middle passage is defined between the first and second joint portions and communicates the two through-holes. Each of the through-holes is penetrated by one of the elastic cord portions, and the elastic loop is spaced into a first loop and a second loop. The middle fastener includes front and rear segments spaced in the longitudinal direction. The front segment includes two spaced clamping walls, and the front segment of the middle fastener extends through the middle passage of the spacer to separate the elastic cord portions in the spacer. The middle fastener resists the elastic cord portions to allow the elastic cord portions to be securely held in the spacer.

In an embodiment, each of the first and second joint portions includes a notch in a front end thereof. Each of the clamping walls has a snap-fit at a front section thereof, and the snap-fits are coupled with the two notches of the spacer. A transverse distance between the first and second side portions is greater than diameters of the elastic cord portions together. Each of the elastic cord portions includes internal and external surfaces opposite to each other. The middle fastener includes two lateral sides resisting the internal surfaces of the elastic cord portions respectively. A diameter of each of the elastic cord portions which is not stretched is slightly larger than an internal diameter of an associated through-hole, allowing the spacer to be fixed on the elastic cord portions. The spacer is movable on the elastic cord portions when the endless elastic loop is stretched to shrink the diameters of the elastic cord portions.

The present invention also provides a creation method of the hair styling device which includes providing an integrated endless elastic loop including two elastic cord portions extending in a longitudinal direction; providing an integrated spacer including two spaced through-holes extending in the longitudinal direction, with a middle passage defined between the spaced through-holes and communicating the two through-holes; penetrating the two elastic cord portions of the elastic loop into the two through-holes of the spacer respectively to allow the elastic loop to be spaced into a first loop and a second loop; and providing a middle fastener which penetrates the middle passage of the spacer to separate the two elastic cord portions inside the spacer, with the middle fastener resisting the two elastic cord portions held in the spacer.

The present invention will become clearer in light of the following detailed description of illustrative embodiments of this invention described in connection with the drawings.

DETAILED DESCRIPTION OF THE INVENTION

Figure 1:
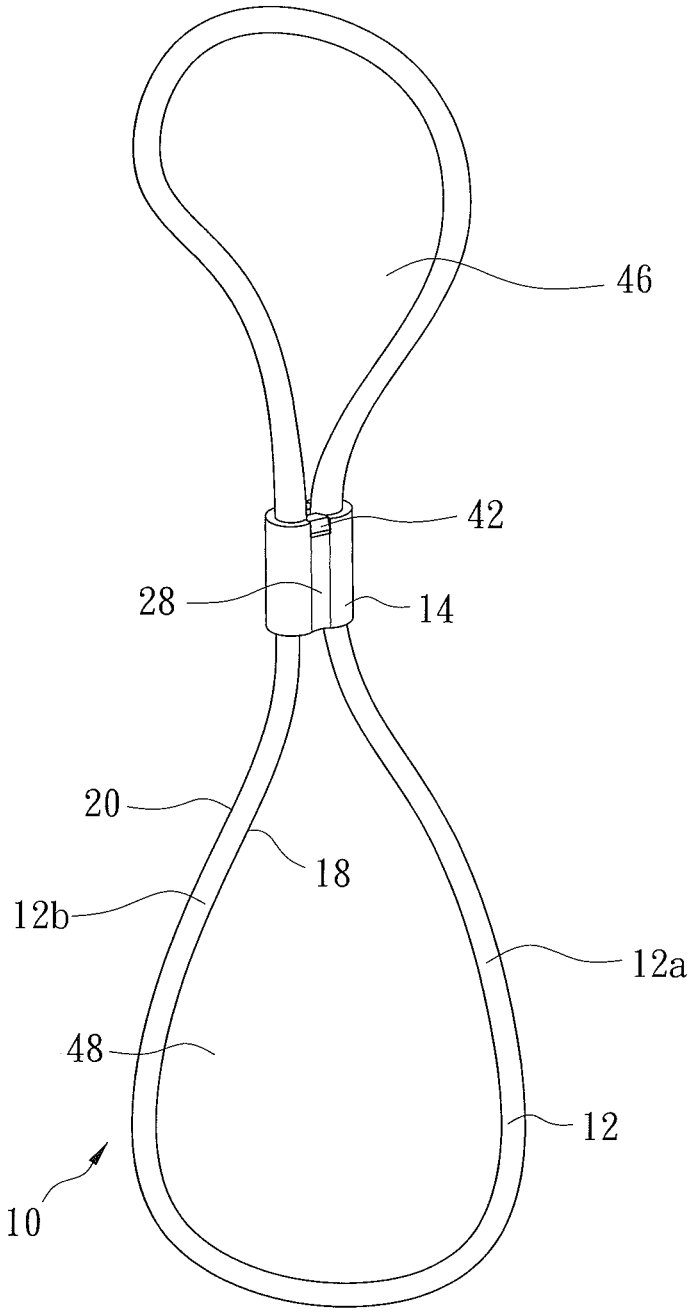
FIG. 1 is a perspective view of a hair styling device according to a first embodiment of the present invention.
Figure 2:
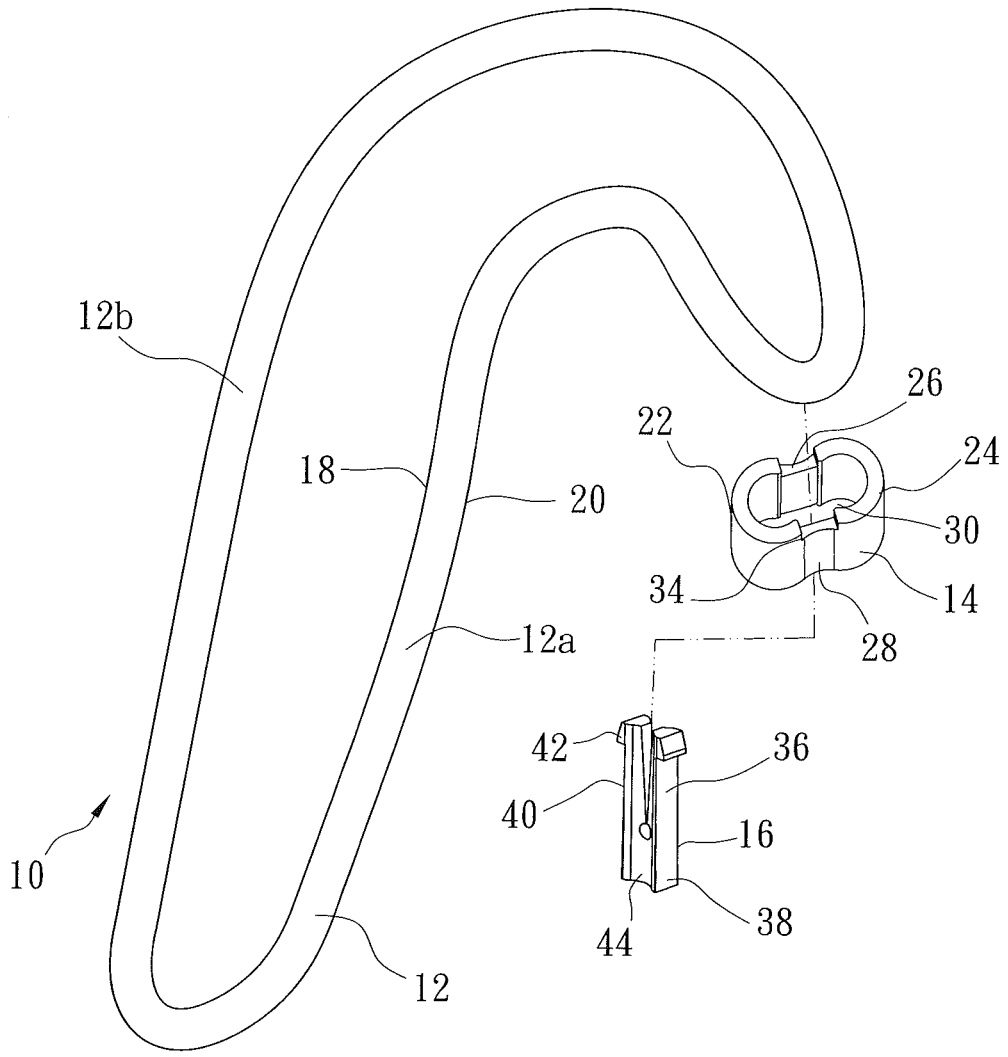
FIG. 2 is an exploded view of the hair styling device of FIG. 1.

A hair styling device 10 according to an embodiment of the present invention and a creation method of the hair styling device 10 are shown in FIGS. 1 through 7 of the drawings. The creation method of the hair styling device 10 includes providing an endless elastic loop 12, at least one spacer 14, and at least one middle fastener 16. In the embodiment, the hair styling device 10 includes a spacer 14 and a middle fastener 16. The endless elastic loop 12, made of rubber, silicone or silk, is manufactured as an integrated one-piece component. The elastic loop 12, which is elongated, includes two elastic cord portions 12*a*, 12*b* extending in a longitudinal direction of the elastic loop 12. Each of the elastic cord portions 12*a*, 12*b* has circular cross-sections and includes internal and external surfaces 18 and 20 opposite to each other.

Figure 3:
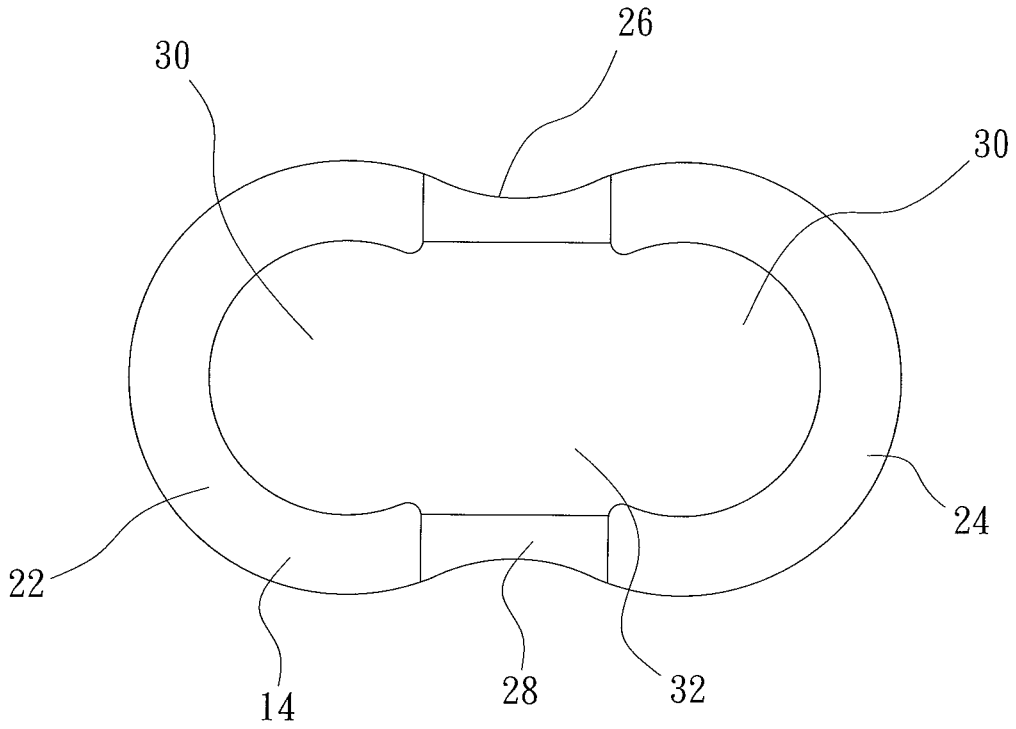
FIG. 3 is a top view of a spacer of the hair styling device of FIG. 1.

The spacer 14 is an integrated hollow sleeve and includes first and second side portions 22 and 24 opposite to each other, as well as first and second joint portions 26 and 28 which are connected between both ends of the first and second side portions 22 and 24 respectively (FIG. 3). The transverse distance between the first and second side portions 22 and 24 is greater than the diameters of the elastic cord portions 12*a*, 12*b* together. In this embodiment, each of the first and second side portions 22 and 24 develops an arc-shaped section and internally defines a semicircular through-hole 30 extending in the longitudinal direction for penetration by one of the elastic cord portions 12*a*, 12*b*. An internal diameter of each through-hole 30 is less than the diameter of one of the elastic cord portions 12*a*, 12*h* which is not stretched. The through-holes 30 are spaced by a middle passage 32 which is defined between the first and second joint portions 26 and 28 and which communicates the two through-holes 30. Each of the first and second joint portions 26 and 28 includes a notch 34 in a front end thereof.

Figure 6:
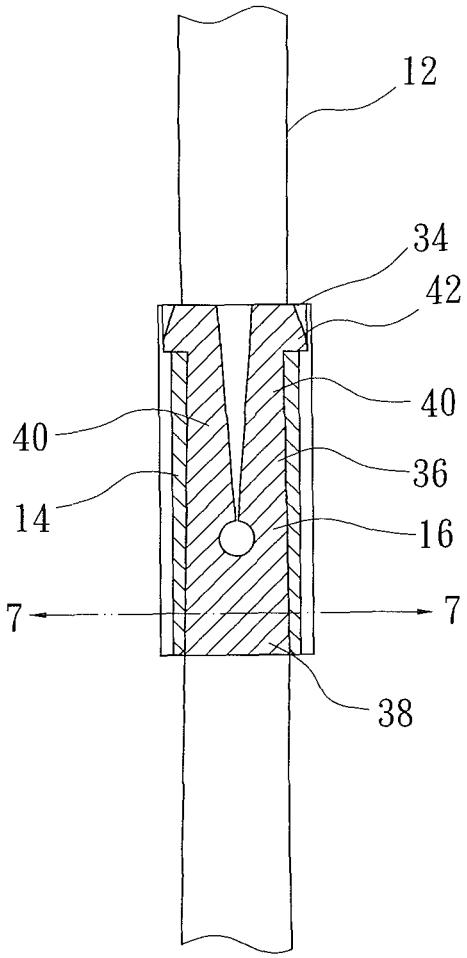
FIG. 6 is a schematic view illustrating the middle fastener of FIG. 5 which is integrated with the spacer.

The middle fastener 16 includes front and rear segments 36 and 38 spaced in the longitudinal direction. The front segment 36 includes two clamping walls 40 spaced from each other, and each of the clamping walls 40 has a hook-like snap-fit 42 at a front section thereof. The clamping walls 40, which are compressed, are able to move inward. The middle passage 32 of the spacer 14 is penetrated by the front segment 36 of the middle fastener 16 when the clamping walls 40 are moved inward. With the middle passage 32 of the spacer 14 penetrated by the front sections of the clamping walls 40, the clamping walls 40 rebound outward, and the snap-fits 42 are coupled with the notches 34 of the spacer 14 (FIG. 6). Furthermore, two lateral sides 44 of the rear segment 38 of the middle fastener 16 develop concave arcs (see FIG. 2 and FIG. 7).

Figure 4:
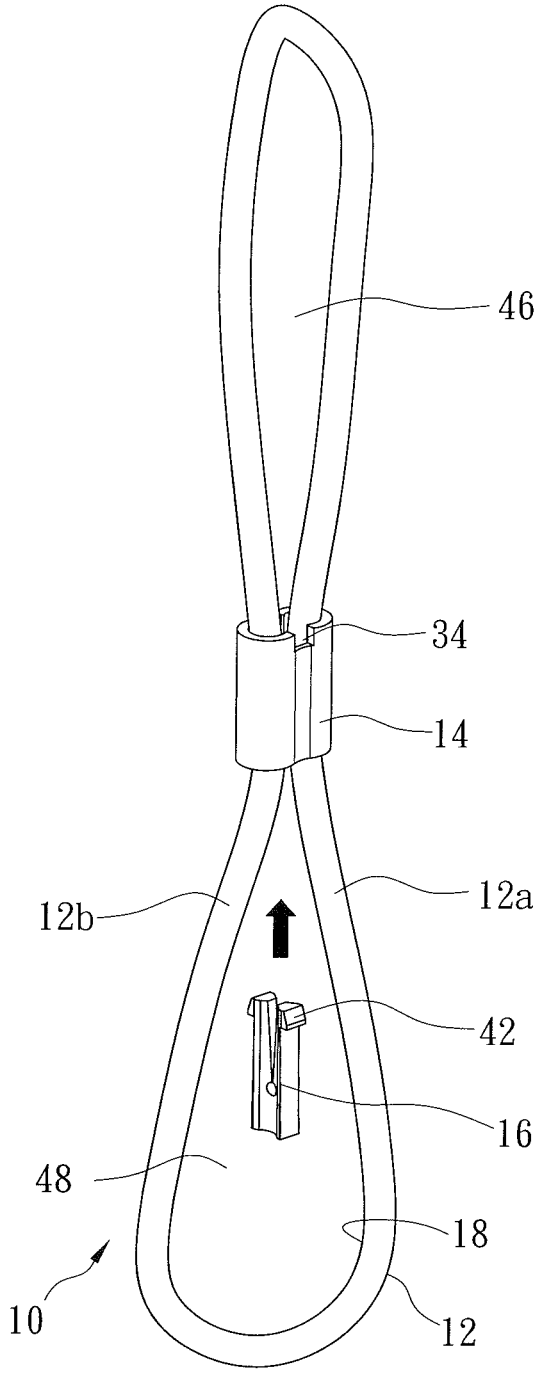
FIG. 4 is a schematic view illustrating the hair styling device of FIG. 1 to be assembled.
Figure 5:
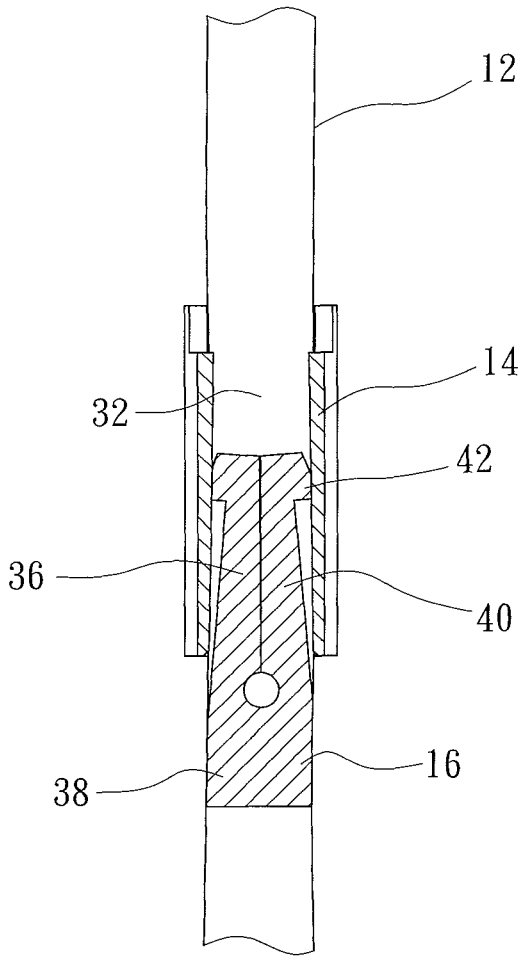
FIG. 5 is a sectional view illustrating a middle fastener of FIG. 4 inserted into the spacer.

The creation method of the hair styling device 10 further includes a step of extending the elastic cord portions 12*a*, 12*b* of the elastic loop 12 through the spacer 14, so that the elastic cord portions 12*a*, 12*b* are located in the through-holes 30 of the spacer 14 respectively (FIG. 4). Thus, the spacer 14 separates the elastic loop 12 into a first loop 46 and a second loop 48.

Figure 7:
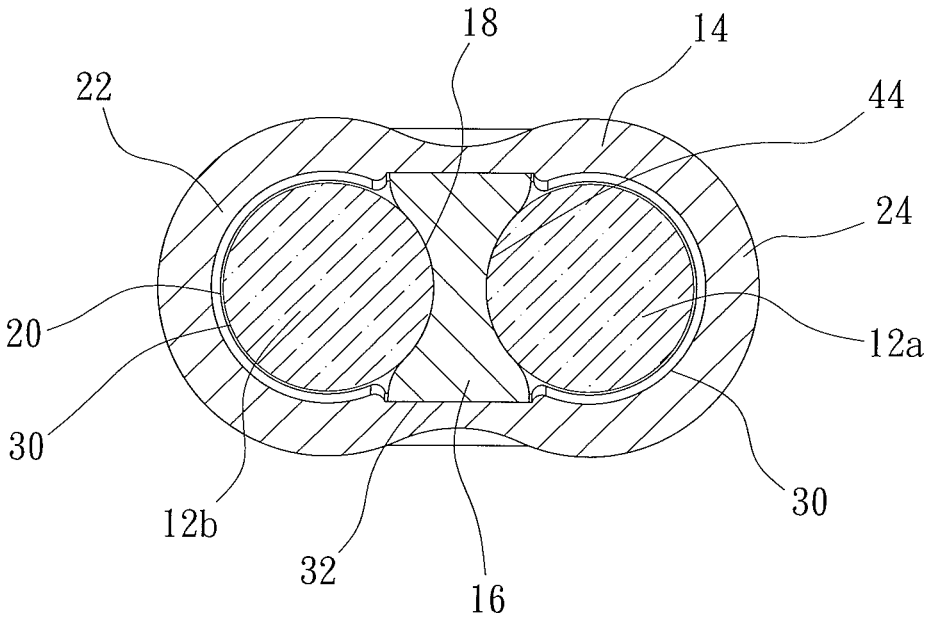
FIG. 7 is a sectional view taken along line 7-7 of FIG. 6.

The creation method of the hair styling device 10 further includes a step of inserting the middle fastener 16 into the middle passage 32 of the spacer 14 (see FIGS. 4 through 6), so that the elastic cord portions 12*a*, 12*b* inside the spacer 14 are spaced by the middle fastener 16. The lateral sides 44 of the middle fastener 16 resist the internal surfaces 18 of the elastic cord portions 12*a*, 12*b*, securely positioning the elastic cord portions 12*a*, 12*b* in the spacer 14 (FIG. 7). Moreover, the spacer 14 can be easily moved to adjust the areas circled by the first loop 46 and the second loop 48. Specifically, when the elastic cord portions 12*a*, 12*b* have been stretched to shrink the diameters thereof, each of the elastic cord portions 12*a*, 12*b* inside the spacer 14 is not resisted by the middle fastener 16, so that the spacer 14 can be moved fast for adjustment of the areas circled by the first loop 46 and the second loop 48.

Figure 8:
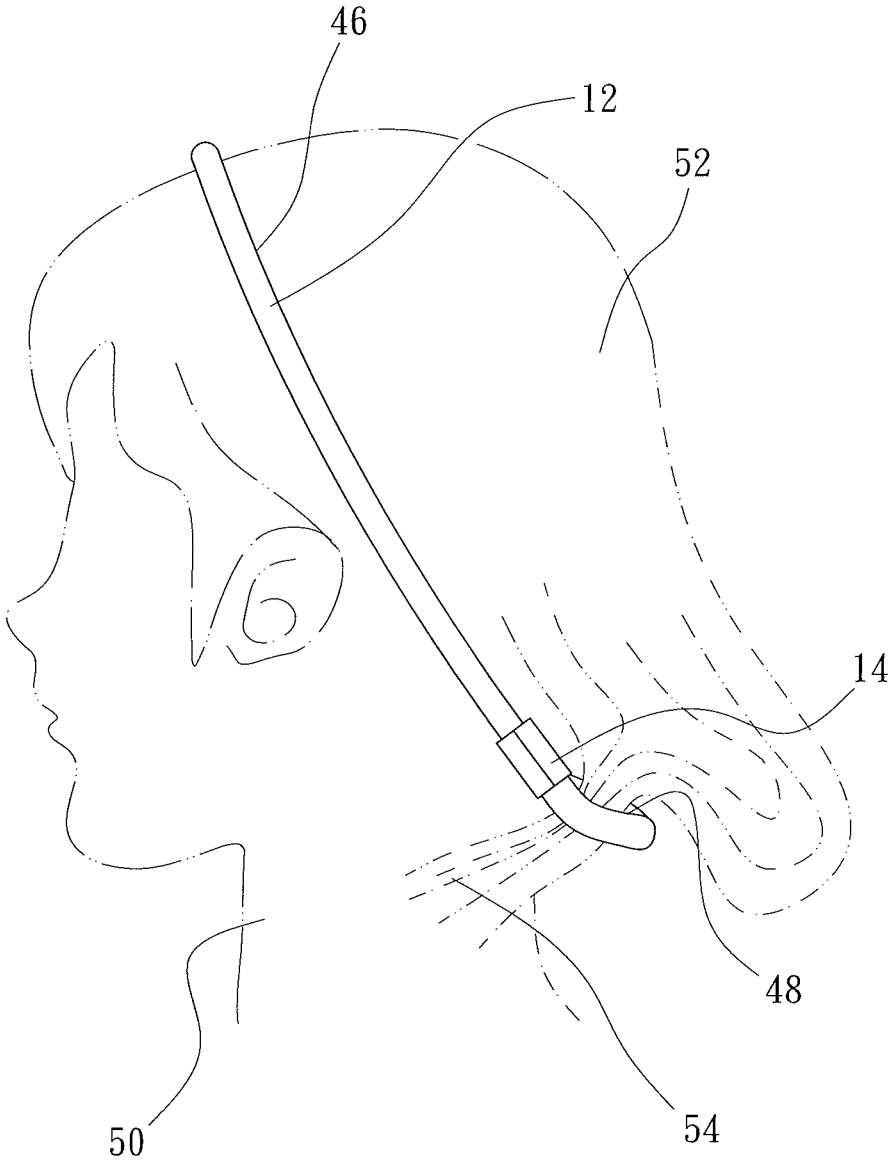
FIG. 8 is a schematic view of the hair styling device of FIG. 1 in service.
Figure 9:
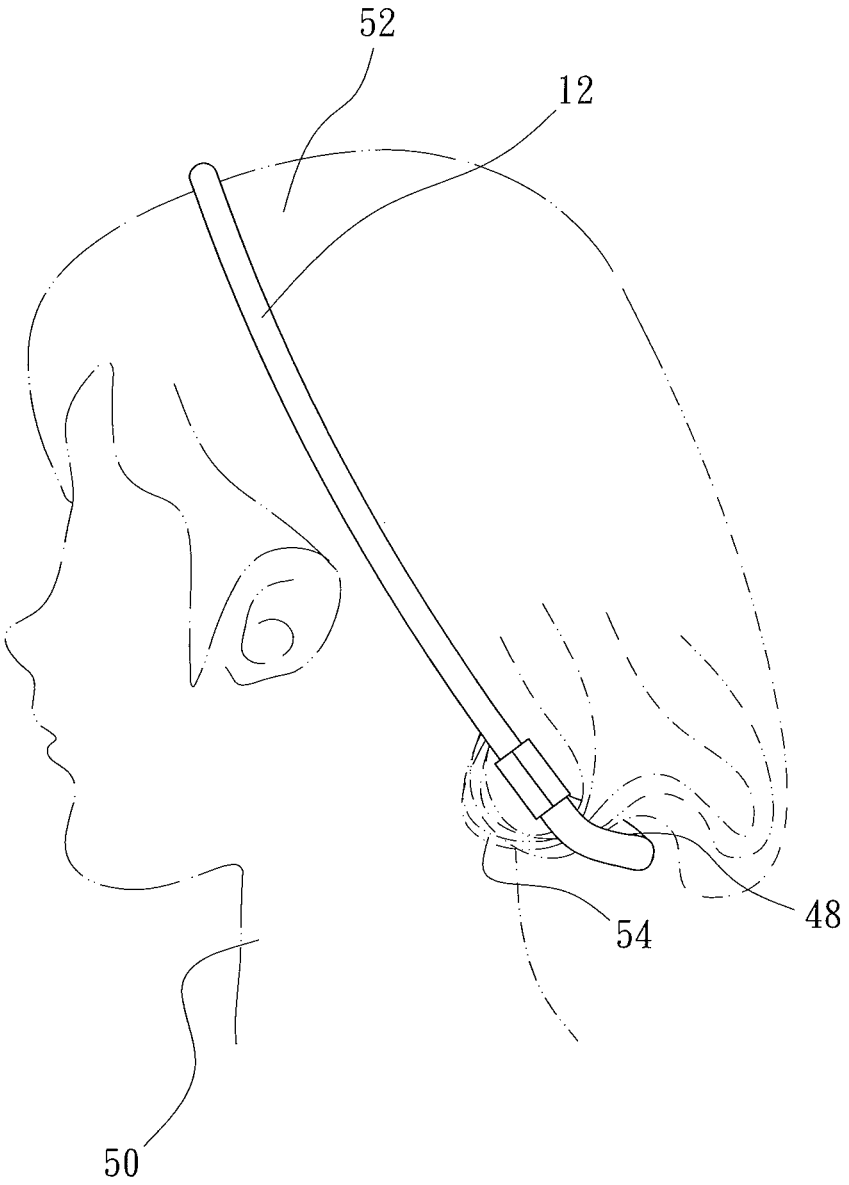
FIG. 9 is a schematic view similar to FIG. 8 and illustrates a fixed status of a user's hairs.

FIGS. 8 and 9 illustrate the hair styling device 10 is taken as a fillet by which a user 50 can change her long hairs to short ones. Hairs of the user 50 are fixed by elasticity of the elastic loop 12 when the head 52 of the user 50 is surrounded by the first loop 46 of the elastic loop 12, and the second loop 48 of the elastic loop 12 is penetrated by hair ends 54 of the user 50.

Figure 10:
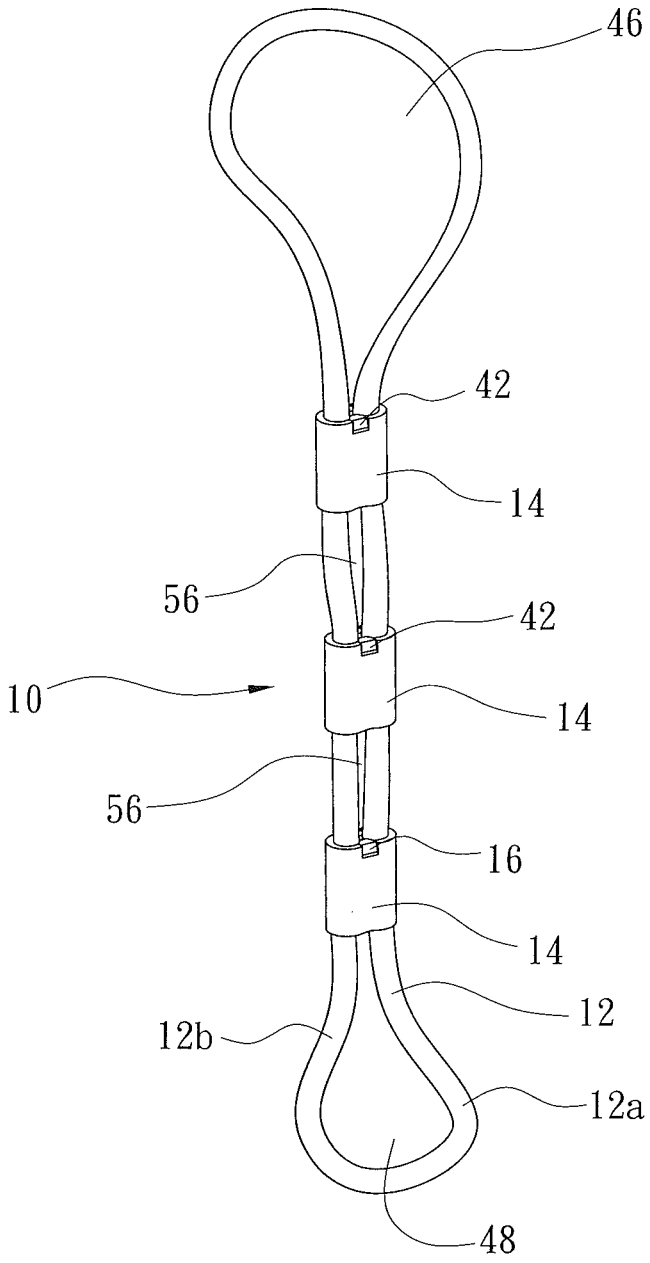
FIG. 10 is a perspective view of a hair styling device according to a second embodiment of the present invention.
Figure 11:
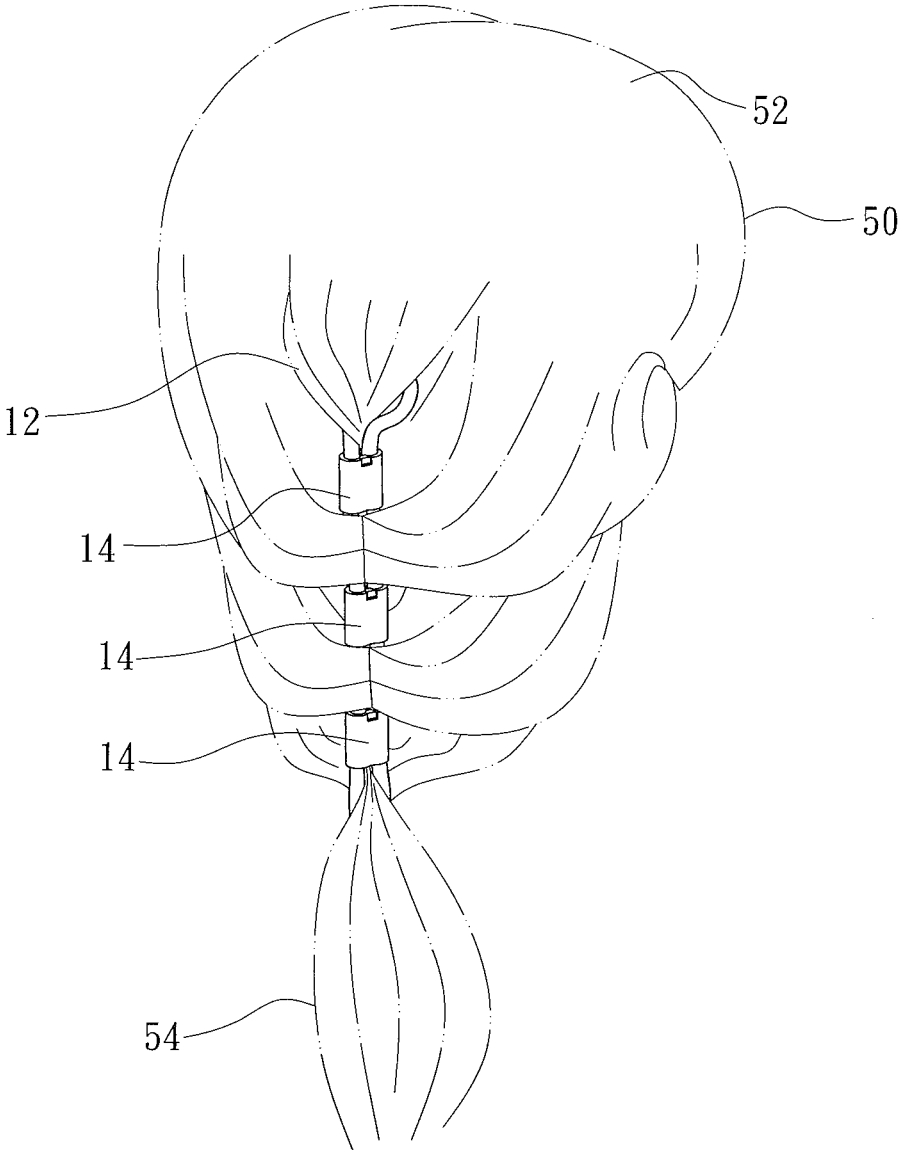
FIG. 11 is a schematic view of the hair styling device of FIG. 10 in service.

FIGS. 10 and 11 illustrate a hair styling device 10 according to a second embodiment of the present invention. In this embodiment, the hair styling device 10 includes a plurality of spacers 14 and a plurality of middle fasteners 16. The spacers 14 are mounted on the elastic cord portions 12*a*, 12*b* separately, and each middle fastener 16 is inserted into and fix an associated spacer 14, so that several middle loops 56 are formed in the elastic loop 12 with each middle loop 56 located between two spacers 14 adjacent to each other. As such, the hair styling device 10 can be taken as a tool for braiding hairs with the middle loops 56 penetrated by hairs of a user. Depending on realistic requirements, a user can simply add more spacers 14 into or remove redundant spacers 14 from the elastic loop 12 for changing the number of the spacers 14. Specifically, the spacers 14 from which the middle fasteners 16 are removed can be quickly disassembled from or assembled on the elastic loop 12.

Figure 12:
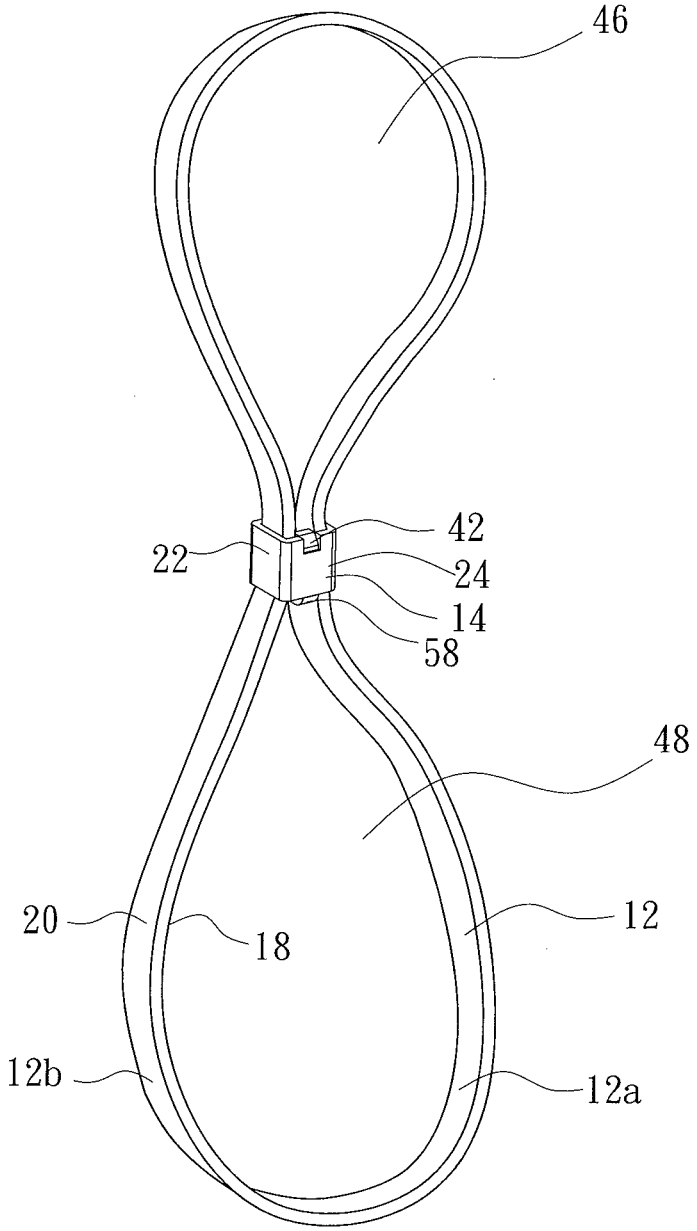
FIG. 12 is a perspective view of a hair styling device according to a third embodiment of the present invention.
Figure 13:
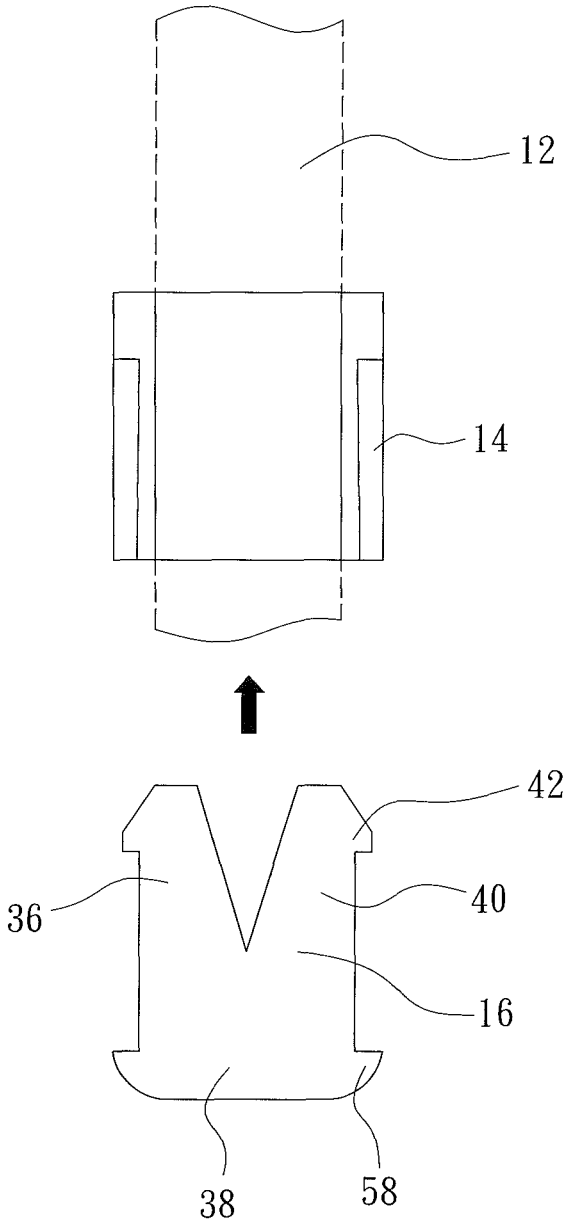
FIG. 13 is a schematic view illustrating a middle fastener of FIG. 12 to be inserted into the spacer.

FIGS. 12 and 13 illustrate a hair styling device 10 according to a third embodiment of the present invention. In this embodiment, the elastic cord portions 12*a*, 12*b* of the elastic loop 12 develop rectangular sections, and the first and second side portions 22 and 24 of the spacer 14 also develop rectangular sections which correspond to the elastic cord portions 12*a*, 12*b*. Furthermore, a salient portion 58 is formed on the rear segment 38 of the middle fastener 16 for resisting and positioning on the spacer 14.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A hair styling device comprising:

an endless elastic loop which is an integrated one-piece component made of elastic material, with the endless elastic loop including two elastic cord portions extending in a longitudinal direction;

at least one spacer which is an integrated hollow sleeve and includes first and second side portions opposite to each other, with the at least one spacer further including first and second joint portions connected between both ends of the first and second side portions respectively, with a through-hole defined in each of the first and second side portions and extending in the longitudinal direction, with the through-holes in the first and second side portions spaced by a middle passage, with the middle passage defined between the first and second joint portions and communicating the through-holes of the first and second side portions, with each of the through-holes of the first and second side portions penetrated by one of the two elastic cord portions; and at least one middle fastener including front and rear segments spaced in the longitudinal direction, with the front segment including two spaced clamping walls, with the front segment of the at least one middle fastener penetrating the middle passage of the at least one spacer to separate the two elastic cord portions in the at least one spacer, with the at least one middle fastener resisting the two elastic cord portions to allow the two elastic cord portions to be securely held in the at least one spacer, wherein each of the first and second joint portions includes a notch in a front end thereof, with each of the two spaced clamping walls having a snap-fit at a front section thereof, with the snap-fits of the two spaced clamping walls coupled with the notches of the first and second joint portions.

2. The hair styling device according to claim 1, wherein a transverse distance between the first and second side portions is greater than diameters of the two elastic cord portions together, with each of the two elastic cord portions including internal and external surfaces opposite to each other, with the at least one middle fastener including two lateral sides resisting the internal surfaces of the two elastic cord portions respectively.

3. The hair styling device according to claim 2, wherein each of the first and second side portions has arc-shaped cross-sections, with each of the two elastic cord portions having circular cross-sections, with each of the two lateral sides of the rear segment of the at least one middle fastener developing a concave arc.

4. The hair styling device according to claim 1, wherein a diameter of each of the two elastic cord portions which is not stretched is slightly larger than an internal diameter of an associated through-hole to allow the at least one spacer to be fixed on the two elastic cord portions, wherein the at least one spacer is movable on the elastic cord portions when the endless elastic loop is stretched to shrink diameters of the two elastic cord portions.

* * * * *